US005827111A

United States Patent [19]

Ball

[11] Patent Number: 5,827,111

[45] Date of Patent: Oct. 27, 1998

[54] METHOD AND APPARATUS FOR GRINDING WAFERS

[75] Inventor: Michael B. Ball, Boise, Id.

[73] Assignee: Micron Technology, Inc., Boise, Id.

[21] Appl. No.: 990,986

[22] Filed: Dec. 15, 1997

[51] Int. Cl.[6] ..... B24B 49/02

[52] U.S. Cl. ..... 451/14; 451/17; 451/41; 451/288; 451/548; 451/550; 451/11

[58] Field of Search ..... 451/11, 14, 17, 451/41, 24, 548, 550, 288

[56] References Cited

U.S. PATENT DOCUMENTS

| | | | |
|---|---|---|---|
| 3,318,053 | 5/1967 | Miller | 451/548 |
| 3,517,466 | 6/1970 | Bouvier | 451/548 |
| 4,016,855 | 4/1977 | Mimata . | |
| 4,227,347 | 10/1980 | Tam . | |
| 4,318,250 | 3/1982 | Klievoneit et al. . | |
| 4,344,260 | 8/1982 | Ogiwara . | |
| 4,478,009 | 10/1984 | Rukavina et al. | 451/14 |
| 4,662,124 | 5/1987 | Kato et al. . | |
| 4,663,890 | 5/1987 | Brandt . | |
| 4,693,036 | 9/1987 | Mori . | |
| 4,753,049 | 6/1988 | Mori . | |
| 4,773,951 | 9/1988 | Moffatt et al. . | |
| 4,802,309 | 2/1989 | Heynacher | 451/41 |
| 4,852,304 | 8/1989 | Honda et al. . | |
| 4,894,597 | 1/1990 | Ohtomi | 318/568.22 |
| 4,894,956 | 1/1990 | Honda et al. . | |
| 4,947,598 | 8/1990 | Sekiya . | |
| 5,035,087 | 7/1991 | Nishiguchi et al. . | |
| 5,111,622 | 5/1992 | Steere, Jr. . | |
| 5,113,622 | 5/1992 | Nishiguchi et al. . | |
| 5,185,956 | 2/1993 | Steere, Jr. . | |
| 5,189,843 | 3/1993 | Steere, Jr. . | |
| 5,329,733 | 7/1994 | Steere, Jr. . | |
| 5,366,924 | 11/1994 | Easter et al. . | |
| 5,545,076 | 8/1996 | Yun et al. . | |
| 5,586,930 | 12/1996 | Hayashi et al. | 451/548 |
| 5,601,732 | 2/1997 | Yoshida . | |
| 5,607,341 | 3/1997 | Leach . | |
| 5,632,667 | 5/1997 | Earl et al. . | |
| 5,679,060 | 10/1997 | Leonard et al. . | |
| 5,679,212 | 10/1997 | Kato et al. . | |

OTHER PUBLICATIONS

Model 7AG — Intelligent Wafer Grinder (Strasbaugh Literature).

*Primary Examiner*—Robert A. Rose
*Assistant Examiner*—George Nguyen
*Attorney, Agent, or Firm*—Dickstein Shapiro Morin & Oshinsky LLP

[57] ABSTRACT

A grinding machine for grinding a wafer includes a pressure sensing grinding wheel having a disk portion, an annular portion depending from the disk portion that includes a plurality of cavities, a grinding tooth disposed in each cavity, and a pressure sensor disposed in each cavity between the tooth and the disk portion. The pressure sensor provides a signal indicative of the pressure applied by the grinding wheel against the wafer to a controller. Based on the signal received, the controller provides control signals to the drive motor and to a feed rate mechanism to maintain optimum grinding action. A method for grinding a wafer includes the steps of receiving a pressure signal from the grinding wheel and changing the feed rate in response to the pressure signal. The controller can also receive, and use for control purposes, additional inputs indicative of the current draw of a drive motor and of the rotational speed of a spindle shaft attached to the grinding wheel.

20 Claims, 4 Drawing Sheets

METHOD AND APPARATUS FOR GRINDING WAFERS

This invention relates to a grinding machine, and in particular, to an automated wafer grinding machine. More particularly, the invention relates to an automated wafer grinding machine using a pressure sensing grinding wheel.

BACKGROUND OF THE INVENTION

As is known, the source material for manufacturing semiconductor chips is usually a relatively large wafer, for example, of silicon. A crystal ingot is sliced to a suitable thickness to obtain a number of nearly disk-shaped semiconductor wafers. Both surfaces of each wafer are subjected to abrasive machining, and then etched in a suitable mixed acid solution. One surface of each wafer is then polished to obtain a mirror surface. Circuits are applied to the mirror surface of the resulting semiconductor wafer by known processing steps of printing, etching, diffusion, doping etc.

The silicon wafers are sliced from the crystal ingot to a thickness that is greater than desirable for a finished integrated circuit product so as to provide a more robust wafer to stand up to the rigors of the integrated circuit fabrication processes. Particularly, relatively thick silicon wafers are necessary during the integrated circuit fabrication steps to prevent warpage and breakage of the wafer as a result of certain heating, handling and other circuit fabrication processes. However, the thickness of the wafer after the integrated circuits are fabricated is greater than desirable for device packaging restrictions. Therefore, it is necessary, after the integrated circuit patterns are defined, to grind a backside surface of the wafer opposite to the frontside surface of the wafer where the integrated circuits are formed to reduce the wafer thickness.

Suitable grinding machines are well known in the art that are capable of grinding down the backside surface of the silicon wafer. Known types of grinding machines generally include a plurality of chuck tables that secure a plurality of wafers to be ground by one or more grinding wheels. It has been found, however, that there are problems in the present wafer processing methods and apparatus. For example, conventional grinding machines move the grinding wheel at constant feed rate, occasionally resulting in increased loading, wafer breakage and an overheating condition that burns wafer tape used to protect the integrated circuit patterns. A grinding machine that sensed the downward force applied to the wafer would allow an adjustment of the feed rate in order to maintain a controlled force applied to the wafer. The application of a controlled force would result in a reduction in loading, less wafer breakage, and elimination of the overheating condition.

Another problem occurs during lift off when the grinding wheel is lifted away from the backside of the wafer. During lift off, swirl marks appear on the backside of the wafer. Swirl marks are also present after sparkout occurs in the grinding process. While these swirl marks do not pose mechanical or electrical problems to the integrated circuits, they are cosmetic imperfections which is sometime objected to by certain customers. Accordingly, it is desirable to eliminate the swirl marks that occur during lift off and sparkout to eliminate the cosmetic imperfections.

Various machines have been suggested to control the grinding forces applied to a wafer. For example, U.S. Pat. No. 5,035,087 to Nishiguchi et al. discloses a grinding machine that compares the shaft motor current and the rotation speed of the shaft with predetermined values to derive actual and desired grinding resistance values. The shaft speed is adjusted to bring the actual grinding resistance value closer to the desired value. U.S. Pat. No. 5,545,076 to Yun et al. discloses an apparatus for removing dust from a wafer during the grinding process that includes a controller for controlling the grinding device and a cleaning device. U.S. Pat. No. 5,607,341 to Leach relates to a method and apparatus for polishing a wafer. Leach discloses a plurality of blocks that move up and down in a grinding wheel. In one embodiment, a magnetic fluid is contained in the grinding wheel and cooperates with a magnet disposed below the wafer to apply a force to the blocks. However, all of these devices apply a constant feed rate to the grinding wheel. None of these machines include means for determining the pressure being applied to the wafer or for controlling the feed rate based on that pressure.

Strasbaugh manufactures a Model 7AF wafer grinder that uses a constant feed rate until the grinding force exceeds a programmed force, at which time the grinding force establishes a removal rate. That is, the Strasbaugh grinding machine uses the grinding wheel dynamics to determine the removal rate rather than the actual pressure applied to the wafer.

SUMMARY OF THE INVENTION

According to the present invention, a wafer grinding machine comprises a grinding wheel having a grinding portion which is movable toward a wafer at a predetermined feed rate. A pressure sensor is coupled to the grinding wheel adjacent the grinding portion, and a controller is coupled to the pressure sensor. The controller is adapted to receive pressure signals from the pressure sensor and change the feed rate of the grinding wheel in response to the pressure signal.

The grinding wheel comprises a disk portion, a grinding surface, and a pressure sensor. The pressure sensor is disposed between the disk portion and grinding surface and provides a signal indicative of pressure applied against the grinding surface.

In a preferred embodiment, the grinding wheel includes a disk portion having a cavity, a grinding tooth, and a pressure sensor. The grinding tooth includes a first end having a grinding surface and a second end disposed in the cavity. The pressure sensor is disposed in the cavity between the second end and the disk portion.

In other preferred embodiments, the grinding wheel includes a plurality of cavities, with a grinding tooth disposed in each cavity. The pressure sensor can be a piezoelectric crystal disposed in the cavity between the second end of the tooth and the disk portion. Alternatively, the pressure sensor can be a fluid at least partially trapped in the cavity between the tooth and the disk portion which transmits the pressure signal hydraulically.

A method for grinding a wafer comprises the steps of moving a grinding wheel at a feed rate relative to the wafer, receiving a pressure signal from the grinding wheel, the pressure signal being indicative of the amount of pressure being applied by the grinding wheel against the wafer, and changing the feed rate of the grinding wheel in response to the pressure signal.

It is therefore an object of the present invention to provide a wafer grinding machine that receives a pressure signal from the grinding wheel.

It is another object of the invention to adjust the feed rate of the grinding wheel in response to the pressure signal received from the grinding wheel.

It is another object of the invention to provide a grinding wheel having a plurality of cavities and a grinding tooth disposed in each cavity.

It is another object of the invention to provide a pressure sensor in each cavity between the grinding tooth and the disk portion. Each pressure sensor provides a signal indicative of the amount of pressure being applied by its respective grinding tooth against the wafer.

It is another object of the invention to provide a method of grinding a wafer that adjusts the feed rate of the grinding wheel in response to the pressure signal received from the pressure sensor.

These and other objects, features and advantages of the invention will become apparent from the following detailed description of preferred embodiments of the present invention.

DETAILED DESCRIPTION OF PREFERRED EMBODIMENTS

Figure 1:
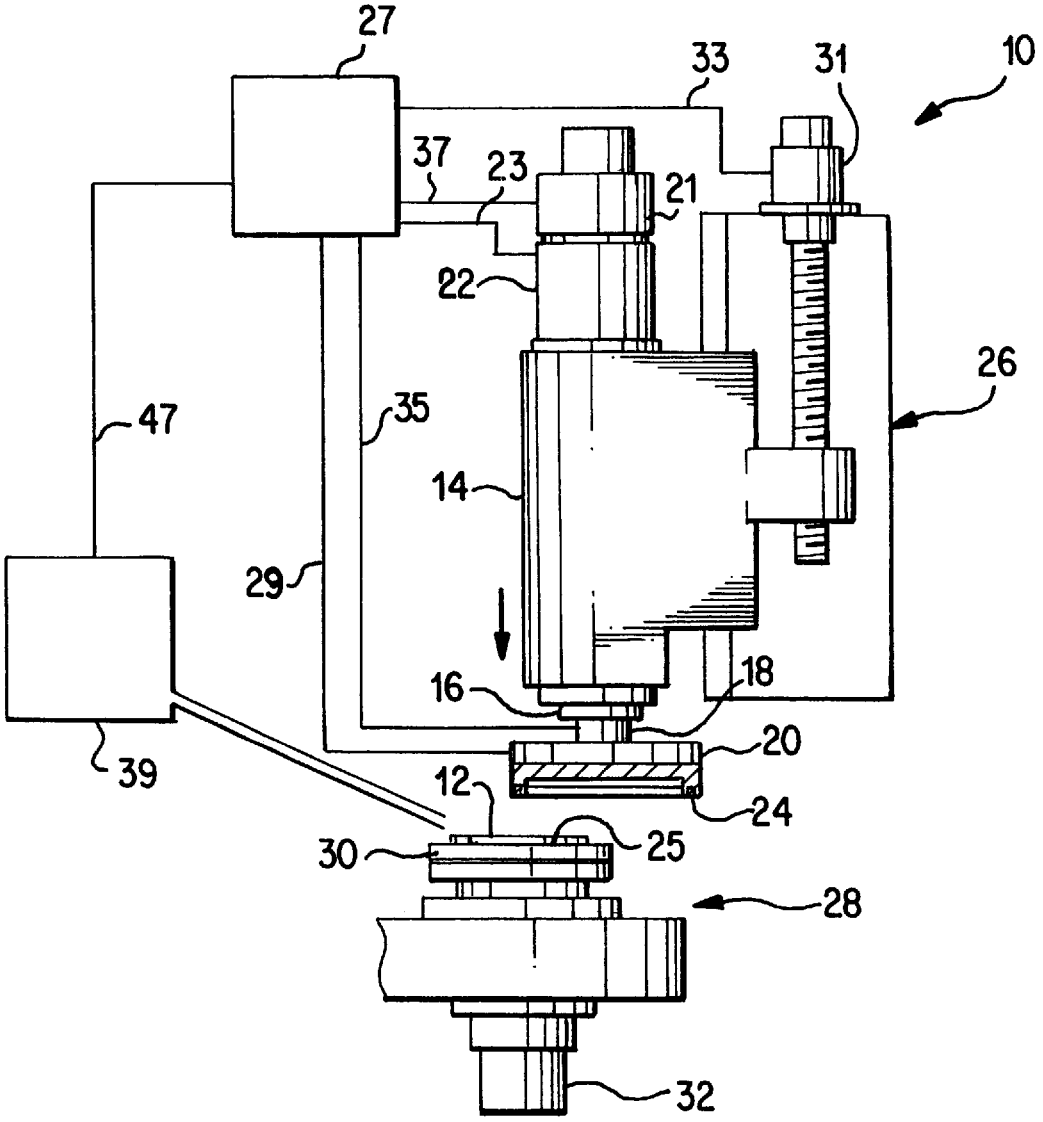
FIG. 1 illustrates a grinding machine according to the present invention.

FIG. 1 is a side view of a grinding machine 10 suitable for grinding a wafer 12. The grinding machine 10 includes a spindle housing 14. The spindle housing 14 includes a spindle 16 having a rotatable grinding shaft 18 and a grinding wheel 20 rigidly secured to the end of the shaft 18. A spindle motor 22 rotates the shaft 18 and thus, the grinding wheel 20 at conventional speeds of 2400–3000 RPM during the grinding process such that the grinding wheel 20 grinds away semiconductor material from the backside surface 25 of the wafer 12. The spindle housing 14 is secured to a conventional feed mechanism 26 such that the placement and feed rate of the grinding wheel 20 can be adjusted relative to the wafer 14 to provide different grinding rates.

A controller 27, such as a computer, is electrically connected to the grinding wheel 20 by electrical conductor 29 and to a feed rate motor 31 by electrical conductor 33. The controller 27 is further connected to a shaft speed sensor 19 by electrical conductor 35, to a spindle motor current detector 21 by electrical conductor 37, and to the spindle motor 22 by electrical conductor 23.

The wafer 12 is secured to a chuck table 28 by a suitable securing mechanism, such as vacuum suction, as is well understood in the art, with the frontside of the wafer 12 that includes the integrated circuits positioned against the chuck table 28. The wafer 12 is secured to a chuck table platform 30, which in turn is secured to a shaft 32 which is driven by a chuck table motor (not shown) at conventional speeds of 50–300 RPM.

Figure 2:
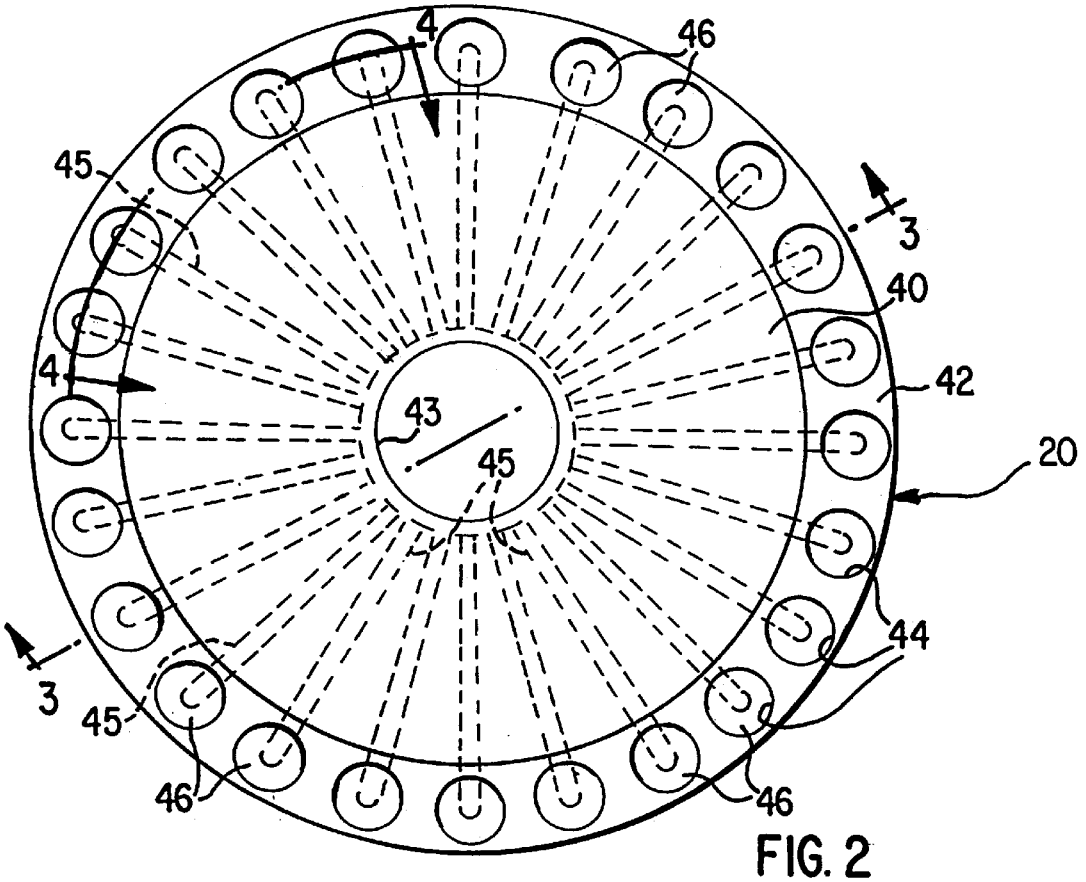
FIG. 2 is a bottom view of a grinding wheel showing a plurality of grinding teeth coupled to the grinding wheel.
Figure 3:
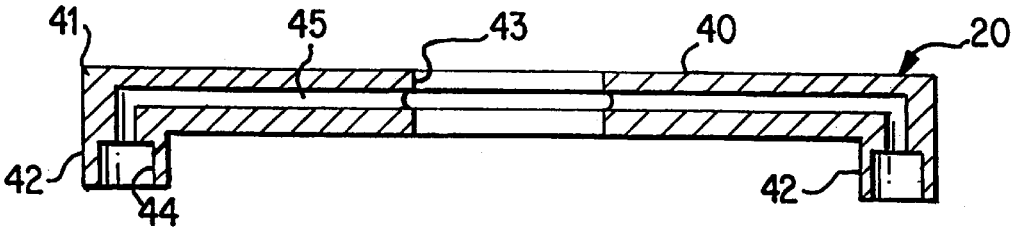
FIG. 3 is a section view taken along line 3—3 of FIG. 1 showing cavities and pressure signal pathways formed in the grinding wheel.
Figure 4:
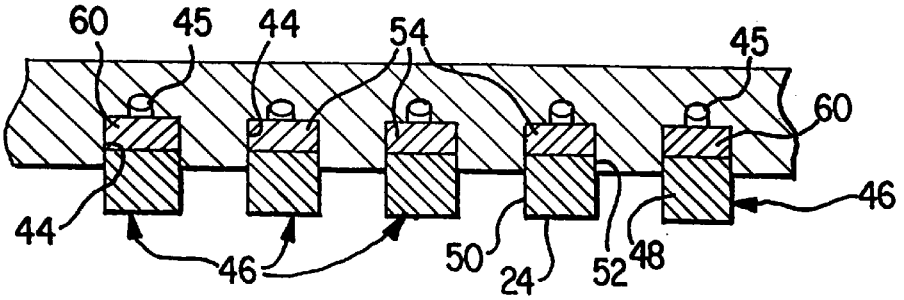
FIG. 4 is a section view of the grinding wheel taken along line 4—4 of FIG. 1.

As seen in FIGS. 2–4, the grinding wheel 20 according to the present invention includes a disk portion 40 and an annular shoulder 42 depending downwardly from the peripheral edge 41 of the disk portion 40. A plurality of cavities 44 are formed in the annular shoulder 42 and a grinding tooth 46 is disposed in each cavity 44. Each cavity 44 is connected to a central shaft-receiving bore 43 by a pressure signal transmission pathway 45.

Each grinding tooth 46 includes a body 48 having a first end 50, which includes the grinding surface 24, and a second end 52. The second end 52 is disposed in the cavity 44. A pressure sensor 54 is disposed in the cavity 44 between the second end 52 and the disk portion 40, as illustrated in FIG. 4.

In preferred embodiments, the pressure sensor 54 includes a piezoelectric element 60. The piezoelectric element 60 typically includes a crystal, such as quartz, that produces an electrical voltage when it is squeezed. In the present invention, the piezoelectric element 60 acts as a transducer to convert mechanical pressure on the grinding teeth 46 into an electrical signal. Thus, as the pressure exerted by the grinding wheel 20 against the wafer 12 is increased or decreased, an electrical signal from the piezoelectric element 60 increases or decreases.

Figure 5:
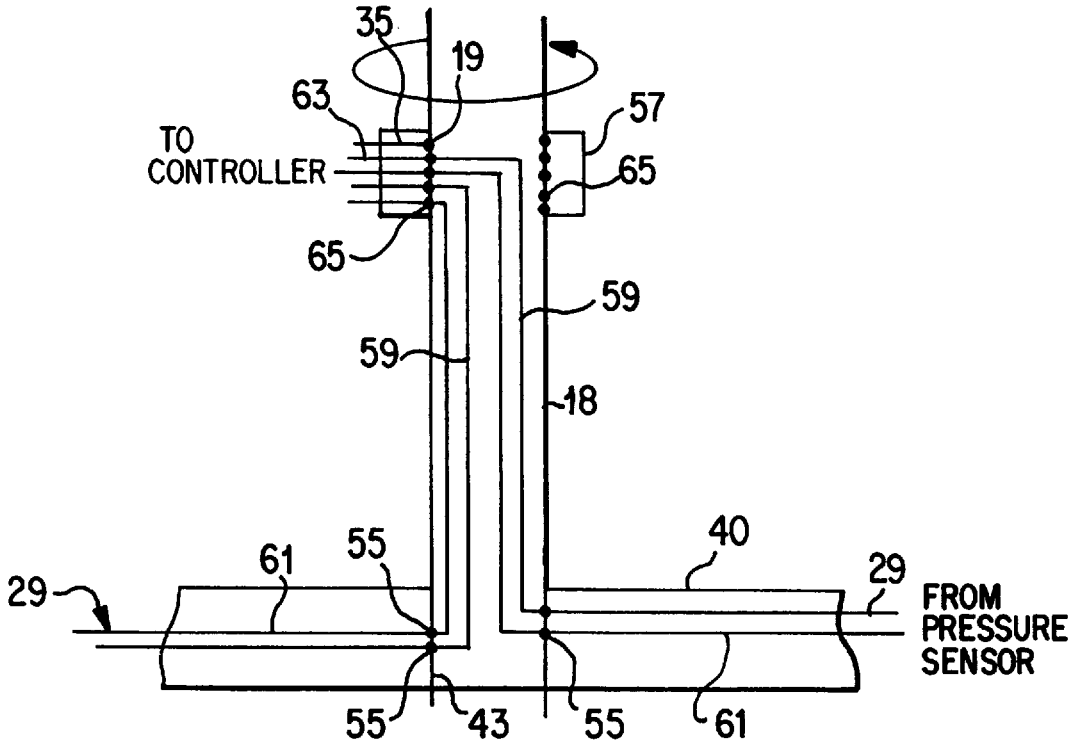
FIG. 5 illustrates a pressure signal pathway from the piezoelectric elements to the controller.

The pressure sensor 54 is electrically connected to the controller 27 by electrical conductor 29. In one embodiment, as illustrated in FIG. 5, electrical conductor 29 includes conductors 61 extending from the pressure sensors 54 to contacts 55 at the shaft-receiving bore 43. The contacts 55 are electrically connected, through electrical conductors 59 in the spindle shaft 18, to a pick-up collar 57. The pick-up collar 57 is electrically connected to the controller 27 by electrical conductors 63, which connect to conductors 59 at contacts 65, providing a pressure signal transmission pathway from the pressure sensors 54 to the controller 27. The pick-up collar 57 can also include the shaft speed sensor 19 for detecting the rotational speed of the shaft 18. Electrical conductor 35 connects the speed sensor 19 to the controller 27. It will be understood by those of ordinary skill that the sensor signals could be multiplexed to eliminate some of the electrical conductors, simplifying construction.

In operation, the feed rate motor 31 actuates the feed mechanism 26 to position the grinding wheel 20 near the backside surface 25 of the wafer 12. Then, with the grinding wheel 20 and the wafer 12 rotating at predetermined rates, but in opposite directions, the feed rate motor 31 moves the grinding wheel 20 at a predetermined feed rate into contact with the wafer 12 to grind the backside surface 25 of the wafer 12. As the pressure increases between the grinding wheel 20 and the wafer 12, the grinding teeth 46 are pushed up into the cavities 44, squeezing the piezoelectric elements 60 therein. As the piezoelectric elements 60 are compressed, they put out a signal via electrical conductors 29 to the controller 27 indicative of the amount of force being applied to them and, therefore, to the wafer 12. The controller 27 also receives input signals from the speed sensor 19 indicative of the rotational speed of the shaft 18 via conductor 35 and from the current detector 21 indicating the amount of current draw of the spindle motor 22 via conductor 37. Based on the signals received, the controller 27 adjusts the feed rate by sending a control signal via electrical conductor 33 to the feed rate motor 31 and controls the rotational speed of the shaft 18 by sending a control signal to the spindle motor 22 via conductor 37 to maintain an optimum grinding action between the grinding wheel 20 and the wafer 12.

Figure 9:
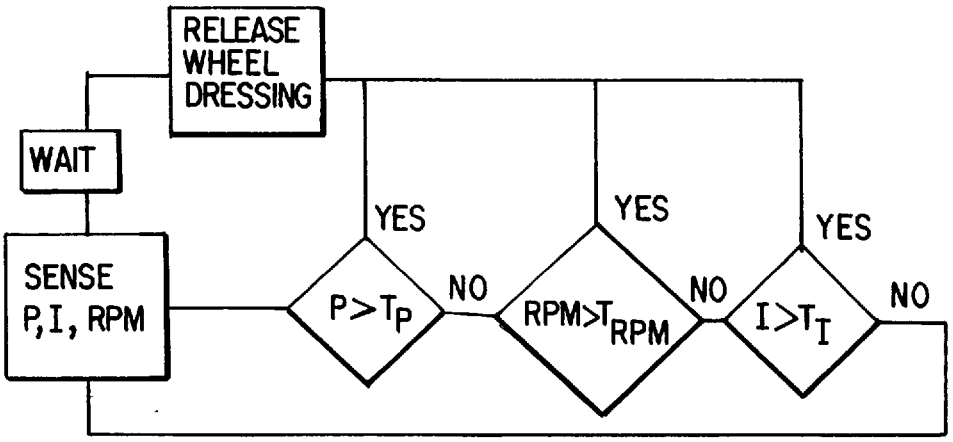
FIG. 9 is a flow diagram of a process for controlling the feed rate.

There are several possible methods whereby the controller 27 can process the input signals. For example, as illustrated FIG. 9, the controller can sense the pressure (P), spindle motor current (I), and shaft speed (RPM) and compare them to threshold values ($T_p$), ($T_I$), ($T_{RPM}$). The controller 27 compares the pressure (P) with the threshold pressure value ($T_p$), and if the pressure is greater than the threshold value, the controller sends a signal to the feed rate mechanism 26 to reduce the feed rate. The controller 27 can then wait a predetermine amount of time until the sensors have had an opportunity to react to the changed feed rate, at which time the controller 27 can receive new values for the pressure, current, and shaft speed. Once the pressure is less than, or equal to, the threshold pressure value, the controller 27 compares the RPM value (R) with the threshold RPM value ($T_{RPM}$) and, if the sensed value (R) is less than the threshold value ($T_{RPM}$), a signal is sent to the feed rate mechanism 26 to reduce the feed rate. Again, if the feed rate is adjusted, the controller 27 waits for the sensors to adjust and then takes new inputs. If the pressure (P) is less than, or equal to, the threshold value ($T_p$), and the shaft speed (RPM) is greater than or equal to the threshold value ($T_{RPM}$), the controller 27 compares the sensed current (I) with the threshold value ($T_I$) If the sensed value (I) exceeds the threshold value ($T_I$), the controller 27 sends a signal to the feed rate mechanism 26 to reduce the feed rate. This sensing and comparing process is continued repeatedly during the grinding process. It will be appreciated by those of ordinary skill in the art that the controller 27 could be limited to sensing and comparing the pressure, and need not sense the motor current (I) or shaft speed (RPM).

In an alternative control scheme, the controller 27 could sense the pressure (P), motor current (I), and shaft speed (RPM) and use one or more of those values as entering arguments in a look-up table or matrix. The table can contain theoretical or empirical data for a feed rate to be used in the event of a given combination of sensed values. It will also be understood that each entering argument could be the difference between the sensed value and the threshold value, or the status of the sensed value as falling inside or outside of a predetermined range of acceptable values.

Figure 6:
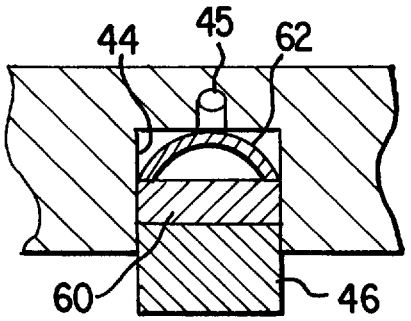
FIG. 6 is a section view taken through an alternative embodiment of the invention.

In an alternative embodiment of the invention, as illustrated in FIG. 6, a leaf spring 62, or other resilient element, is inserted in the cavity 44 between the piezoelectric element 60 and the disk portion 40. The leaf spring 62 allows the grinding machine 10 to pick up an electrical signal from the piezoelectric element 60, while easing the forces applied to the wafer 12 during lift off by adjusting the feed rate. Reducing the applied downward forces in a slow controlled manner as the grinding machine completes the wafer grinding process results in a finer finish, increased die strength at sparkout or lift off, and reduced total thickness variation.

Figure 7:
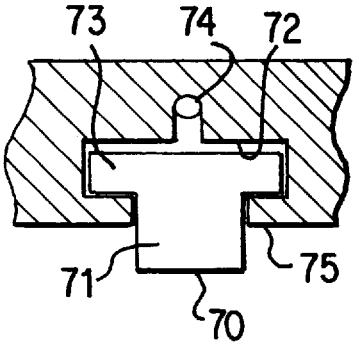
FIG. 7 is a section view taken through another alternative embodiment of the invention.
Figure 8:
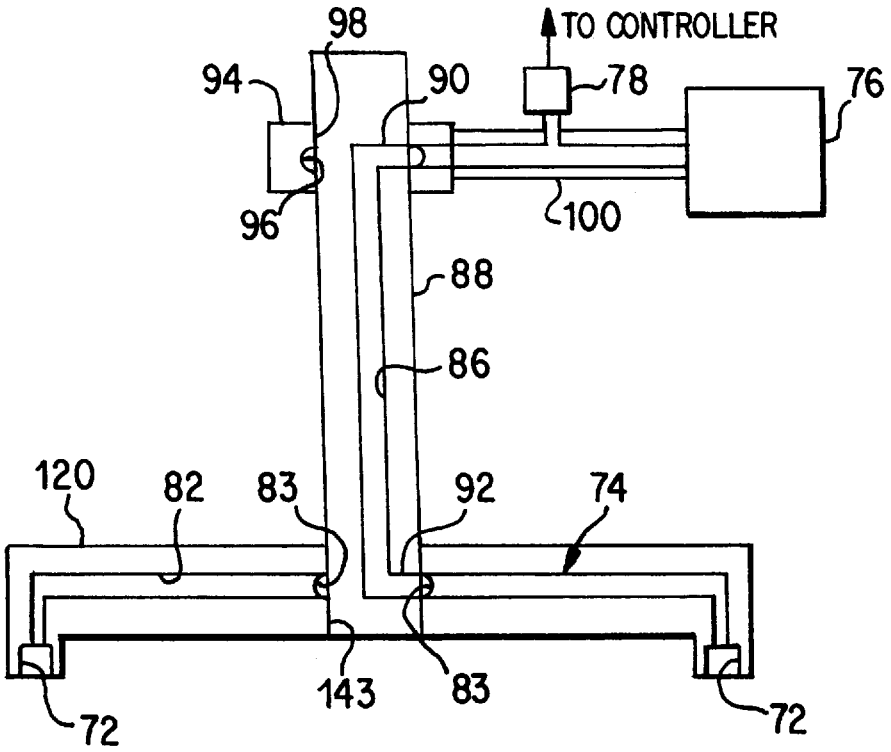
FIG. 8 illustrates a fluid pressure signal pathway between the cavities and a fluid source.

In yet another embodiment of the invention, a T-shaped tooth 70 having a base portion 71 and a cap portion 73 is disposed in a T-shape cavity 72 formed by an inwardly extending annular flange 75. As illustrated in FIGS. 7 and 8, pressure signal transmission pathway 74 includes a fluid-carrying conduit that connects the cavity 72 with a source 76 of fluid. The fluid provides the function of pressure sensing, with the pressure signal being transmitted through the pathway 74 to a pressure detector 78 that converts the hydraulic signal into an electrical signal for processing by a controller 27.

FIG. 8 illustrates the pathway 74 for a pressure signal from the cavities 72 to the controller 27. Fluid carrying bores 82 are formed in the grinding wheel 120 and extend from the shaft-receiving bore 143 to each cavity 72. The fluid-carrying bores 82 are fluidly connected to each other by a channel 83 formed in the grinding wheel 120 adjacent the shaft-receiving bore 143. An axially extending bore 86 is formed in the shaft 88 and includes an inlet 90 and an outlet 92. A fluid coupler 94 is rotatably coupled to the shaft 88 and extends therearound. The coupler 94 includes a channel 96 adjacent a central shaft-receiving bore 98 to ensure fluid contact with the inlet 90 regardless of the angular position of the shaft 88. The outlet 92 is positioned to open into the channel 83 formed in the grinding wheel 88. Thus, the cavities 72 are in fluidly connected to the coupler 94. The coupler 94 is fluidly connected by conduit 100 to the fluid source 76. A pressure detector 78 taps into conduit 100 to detect fluid pressure in the conduit 100 and provide a pressure signal to the controller 27.

Advantageously, the fluid can be coolant used to cool the wafer 12 during the grinding process. In a non-grinding condition, the coolant fluid pushes the cap portion 73 of the tooth 70 against the flange 75 to substantially seal the cavity 72. As grinding begins, heat builds up on the wafer 12 and an increasing pressure is exerted against the tooth 70. As the pressure increases, the grinding tooth 70 is pushed up into the cavity 72, lifting the cap portion 73 away from the flange 75, allowing an increased flow of coolant out of the cavity 72. The increased flow of coolant fluid out of the cavity 72 is accompanied by a corresponding change in fluid pressure in the cavity 72. The pressure change is detected at the detector 78 and converted to an electrical signal indicative of the pressure applied by the grinding wheel 120 against the wafer 12 and sent to the controller 27.

The above descriptions and drawings are only illustrative of preferred embodiments which achieve the objects, features and advantages of the present invention, and it is not intended that the present invention be limited thereto. Any modification of the present invention which comes within the spirit and scope of the following claims is considered part of the present invention.

What is claimed as new and desired to be protected by Letters Patent of the United States is:

1. A wafer grinding machine comprising a grinding wheel having a grinding portion and at least one pressure sensor and being movable at a predetermined feed rate, the pressure sensor being disposed adjacent the grinding portion, and a controller coupled to the pressure sensor, the controller being adapted to receive pressure signals from the pressure sensor and change the feed rate of the grinding wheel in response to the pressure signal.

2. The grinding machine of claim 1 wherein the grinding portion includes a plurality of teeth and at least one pressure sensor disposed between at least one of the plurality of teeth and the grinding wheel.

3. A wafer grinding machine comprising a rotating grinding wheel having a disk, an annular shoulder depending from the disk, the annular shoulder including a grinding surface, and a pressure sensor disposed between the grinding surface and the disk.

4. The grinding machine of claim 3 wherein the annular shoulder includes a plurality of cavities and the grinding surface includes a plurality of teeth disposed in the plurality of cavities and the pressure sensor includes a plurality of pressure sensors disposed in the plurality of cavities between the plurality of teeth and the disk.

5. The grinding machine of claim 4 further comprising a spindle shaft speed sensor and a spindle motor current detector, the controller being configured to receive an input signal from each and controlling the rotational speed of the grinding wheel in response to at least one of the received signals.

6. A wafer grinding machine comprising a rotating grinding wheel, a plurality of teeth coupled to the grinding wheel, a plurality of pressure sensors, with one pressure sensor disposed between each of the plurality of teeth and the grinding wheel, a feed mechanism coupled to the grinding wheel for moving the grinding wheel at a predetermined feed rate, a spindle shaft speed sensor for detecting the speed of rotation of the grinding wheel, a spindle motor current detector, and a controller coupled to the feed mechanism, the plurality of pressure sensors, the shaft speed sensor, and to the motor current detector, the controller changing at least one of the feed rate and rotational speed of the grinding wheel in response to signals received from at least one of the pressure sensor, shaft speed sensor and the motor current detector.

7. A wafer grinding machine comprising a grinding wheel, a grinding wheel drive mechanism coupled to the grinding wheel, at least one tooth coupled to the grinding wheel, at least one pressure signal transmitter disposed adjacent the at least one tooth, the at least one pressure signal transmitter providing a signal indicative of the amount of pressure exerted on the at least one tooth, and a control device responsive to a pressure signal from the at least one pressure signal transmitter, the control device being coupled to the grinding wheel drive mechanism to change a feed rate of the grinding wheel.

8. A pressure sensitive wafer grinding wheel comprising a disk, a plurality of grinding teeth coupled to the disk, and a pressure signal transmitter disposed between each grinding tooth and the disk.

9. The grinding wheel of claim 8 further including a plurality of pressure signal transmission pathways connecting a pressure signal receiver to the plurality of grinding teeth.

10. A pressure sensitive wafer grinding wheel comprising a disk portion having a cavity, a grinding tooth, and a pressure sensor, the grinding tooth including a first end having a grinding surface and a second end disposed in the cavity, the pressure sensor being disposed in the cavity between the second end and the disk portion.

11. A pressure sensing wafer grinding wheel comprising a disk portion, a grinding surface, and a pressure sensor disposed between the disk portion and grinding surface, the pressure sensor providing a signal indicative of pressure applied to the grinding surface.

12. A pressure sensing system for a wafer grinder comprises a wafer grinding wheel, a grinding tooth having a body, a first end having a grinding surface, and a second end, and a pressure transmitter disposed between the second end and the grinding wheel.

13. The system of claim 12 wherein the grinding wheel includes a cavity and the pressure transmitter includes a fluid disposed in the cavity.

14. The system of claim 12 wherein the grinding wheel includes a cavity and the pressure transmitter includes a piezoelectric material adjacent the tooth body and a resilient member disposed in the cavity adjacent the piezoelectric material.

15. The system of claim 12 wherein the grinding wheel includes a cavity having a fluid inlet and a fluid outlet, the cavity being in fluid communication with a fluid source and a fluid pressure detector, the grinding tooth being disposed in the cavity to at least partially block the fluid outlet to restrict the flow of fluid out the fluid outlet.

16. A grinding system comprises a wafer grinding wheel, a grinding tooth having a body, a first end and a second end, the first end having a grinding surface, the grinding wheel including a cavity, in fluid communication with a fluid source and a fluid pressure detector, the second end of the tooth being disposed in the cavity to at least partially block fluid outflow from the cavity, wherein fluid in the cavity transmits a pressure signal to the pressure detector indicative of the pressure applied to the tooth.

17. A method of grinding a wafer comprising the the steps of moving a pressure sensing grinding wheel at a predetermined feed rate, receiving a pressure signal from a pressure sensor disposed in the grinding wheel, the signal being indicative of the amount of pressure sensed by the grinding wheel, and changing the feed rate in response to the signal.

18. A method of grinding a wafer comprising the steps of moving a grinding wheel at a predetermined feed rate, receiving a pressure signal from the grinding wheel, wherein the grinding wheel includes a plurality of cavities, a plurality of grinding teeth disposed in the plurality of cavities, and a pressure sensor in each cavity configured to provide the pressure signal, and changing the feed rate in response to the signal.

19. A method for grinding a wafer comprising the steps of moving a grinding wheel relative to the wafer, the grinding wheel having a plurality of pressure sensing teeth and a plurality of pressure sensors, each pressure sensor providing a pressure signal indicative of the amount of pressure sensed by one of the plurality of teeth, and changing the rate of movement of the grinding wheel in response to the pressure signals from the plurality of pressure sensors.

20. A grinding tooth for use with a wafer grinding wheel, the grinding tooth comprising a body having a first end and a second end, a layer of grinding material affixed to the first end, a pressure sensor disposed between the second end and the grinding wheel, and electrical connectors coupled to the pressure sensor and to the grinding wheel, the electrical connectors carrying a pressure signal from the pressure sensor to a controller for controlling the movement of the grinding wheel.

* * * * *